United States Patent [19]

Zach

[11] Patent Number: 4,515,071

[45] Date of Patent: May 7, 1985

[54] VENTILATION AIR CONTROL UNIT

[76] Inventor: Elmer S. Zach, R.R. #2, Box 118, Humphrey, Nebr. 68642

[21] Appl. No.: 422,068

[22] Filed: Sep. 23, 1982

Related U.S. Application Data

[63] Continuation-in-part of Ser. No. 365,113, Apr. 5, 1982, abandoned.

[51] Int. Cl.[3] ..... E04H 7/00; F04D 29/52

[52] U.S. Cl. ..... 98/55; 34/233; 415/213 C

[58] Field of Search ..... 34/233; 98/55; 415/210, 415/213 C, DIG. 1

[56] References Cited

U.S. PATENT DOCUMENTS

| | | | |
|---|---|---|---|
| 2,628,019 | 2/1953 | Koch | 415/210 X |
| 2,808,197 | 10/1957 | Forgó | 415/DIG. 1 |
| 2,922,277 | 1/1960 | Bertin | 415/DIG. 1 |
| 3,191,364 | 6/1965 | Sylan | 415/DIG. 1 |
| 3,383,700 | 5/1968 | Taylor | 415/210 X |

FOREIGN PATENT DOCUMENTS

| | | | |
|---|---|---|---|
| 872010 | 6/1971 | Canada | 415/DIG. 1 |
| 2913922 | 10/1980 | Fed. Rep. of Germany | 415/213 C |

*Primary Examiner*—Harold Joyce
*Attorney, Agent, or Firm*—E. Robert Newman

[57] ABSTRACT

An improved ventilation air control unit for use in grain drying and storage apparatus. The unit includes a pneumatic pathway unit that will accommodate a large fan blade, a motor and fan blade unit for causing air to move through the pneumatic unit, and a supplemental feed unit to provide supplemental air for delivery into the grain bin and for reducing air slippage around the fan blade.

8 Claims, 6 Drawing Figures

VENTILATION AIR CONTROL UNIT

This application is a continuation-in-part of application Ser. No. 365,113 filed Apr. 5, 1982 now abandoned.

TECHNICAL FIELD

This invention relates to ventilation air control units in general and in particular as used in grain drying and storage apparatus.

BACKGROUND ART

Grain bins have long been used for the drying and storing of grain. Such bins typically include a large containment vessel having cylindrically shaped side walls constructed of galvanized corrugated steel extending upwardly from a base and further having an angled roof sloping upwardly from the upper edge of the side wall. A port will usually be located at the apex of the roof.

This containment vessel will usually be positioned upon a concrete base or platform. A perforated floor will usually be supported within the bin and will be spaced somewhat above the base to form a plenum chamber therebetween.

One or more fans or other air circulation mechanisms will be positioned about the lower periphery of the side wall and will be in pneumatic communication with the plenum chamber. By use of these air circulation mechanisms, air may be forced into the plenum chamber and up through the perforated floor through the grain and then out through the apex port. Conversely, the same system may serve to draw air out of the containment vessel by reversing the air flow.

Air circulation mechanisms such as those referred to above typically include a pneumatic pathway having a motor and fan blade unit mounted therein. One end of the pathway will be pneumatically connected to the grain bin as described above. The remaining end of the pathway will usually be connected to some sort of vent or filter screen.

Usually, the fan blade used in such air circulation mechanisms will not exceed a twelve inch diameter. In consequence, the pneumatic pathways are usually comprised of tubes having an inner diameter of approximately twelve inches as well.

Lately, newer and more efficient fan blades have been introduced. Many of these improved fan blades have a fourteen inch span. The operator of a grain drying installation who wishes to use such improved fan blades must then confront a dilemma. He must either purchase all new ventilation air control equipment to accommodate the new blade, or dramatically modify the existing equipment.

It would be desirable to provide such operators with a way to utilize such new fan blades without making obsolete the ventilation air control units he already has. Such operates could then obtain ventilation air control systems having a higher static pressure in combination with a greater volume of air movement at a reasonable cost.

It should be understood that the dimensions hereinabove stated are illustrative only and that the principles of my invention will apply to any size fan blade and housing smaller and larger.

DISCLOSURE OF INVENTION

The above problems are resolved when it is desired to force air into the containment vessel by use of the herein described invention that relates to an improved ventilation air control unit. This improved unit includes generally a second tube having an inner diameter of approximately fourteen inches. So dimensioned, this second tube will accommodate a fourteen inch fan blade span.

This second tube includes an attachment unit to facilitate easy joining of the second tube to a preexisting first tube and the containment vessel. So joined, the two tubes constitute a single pneumatic pathway.

To assist in delivering a higher static pressure at the output of the ventilation air control unit, the inventor has determined that an annular shaped flange should be installed with the second tube upstream of and proximal to the fan blade. This flange serves to reduce air slippage about the tips of the fan blade. As a result, higher static pressure may be realized at the output.

In order to provide a greater volume of air at the output, the applicant has determined that ports may be disposed through the pneumatic pathway upstream of the annular shaped flange. These ports may be provided with gates to allow the operator to close them when air is to be drawn out of the containment vessels by use of either a reversible motor or by reversing the pneumatic pathway 180° and reinstalling it with a canvas reducing section or the like. These ports then provide a supplemental source of air that the fan blade may pull from upstream and push downstream. As a result, a greater volume of air may be moved through the improved ventilation air control unit.

In another embodiment which further increases air flow throughout the pneumatic pathway, a plurality of air scoops are disposed within the pathway each of the ports. In this embodiment the upstream end of the second tube must extend over the ports far enough that, when air is diverted by the scoops out of the first tube through the ports, it will mix with the surrounding air entering around the first tube into the second tube. Air will then flow back into the pneumatic passageway downstream from said air scoops. The continuous flow of air out of the pneumatic passageway, and then back into the passageway creates negative pressure and sufficient suction to pull increased quantities of external air into the system.

As an example, when a twelve inch fan blade is utilized in combination with a one horsepower motor at two inches of static pressure, approximately 500 cubic feet of air will be moved through a conventional twelve inch tube. By the use of a fourteen inch fan blade in conjunction with the embodiment just described, over 1300 cubic feet of air can be moved through the pneumatic passageway.

BRIEF DESCRIPTION OF THE DRAWINGS

These and other attributes of the improved ventilation air control unit should become more clear upon a thorough review of the following description of the best mode for carrying out the invention, and particularly when studied in connection with the drawings, wherein.

MODES FOR CARRYING OUT THE INVENTION

Figure 1:
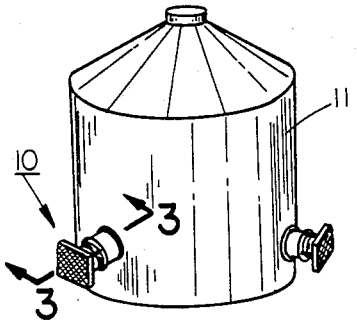
FIG. 1 is a reduced perspective view of several ventilation air control units as attached to a grain bin.

Referring now to the drawings, and in particular to FIG. 1, the ventilation air control unit may be seen as denoted generally by the numeral 10. The ventilation air control unit (10) is shown as connected to a generically represented grain bin (11).

Figure 3:
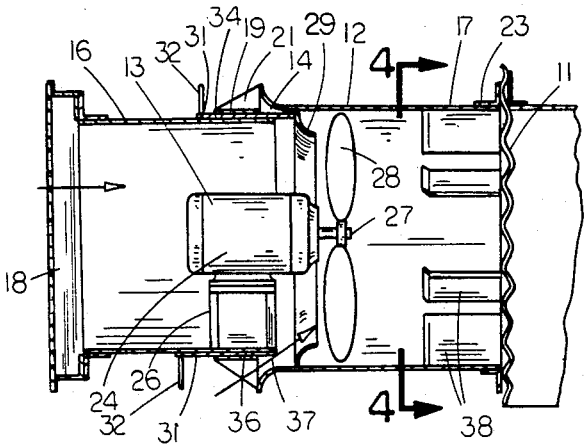
FIG. 3 is a side elevational view of the ventilation air control unit as connected to a grain bin and as shown sectioned through the plane indicated in FIGS. 1 and 2.

Referring to FIG. 3, the ventilation air control unit (10) includes generally a pneumatic pathway unit (12), a motor and fan blade unit (13) and a supplemental feed unit (14). Each of these units (12, 13 and 14) will now be described in seriatim fashion.

The pneumatic pathway unit (12) may be comprised generally of a first tube (16) and a second tube (17). The first tube (16) may be comprised of the already existing tube of the previously installed ventilation air control unit. Such a tube (16) will typically have an interior diameter of approximately twelve inches.

One end of the first tube (16) will already have been connected to a vent or filter unit (18) in the preexisting installation, and this vent or filter unit (18) may be left intact.

The remaining end of the first tube (16) may be disposed somewhat within the second tube (17), the second tube (17) having an interior diameter of approximately fourteen inches. The two tubes (16 and 17) may then be affixed to one another by any appropriate means of attachment.

Figure 2:
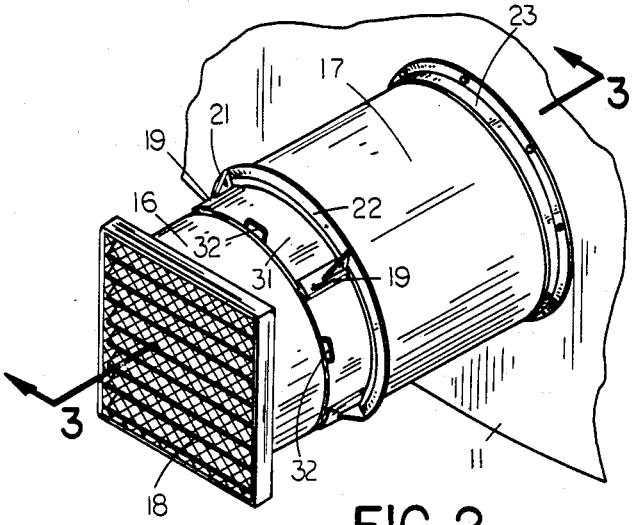
FIG. 2 is a perspective view of the ventilation air control unit as shown attached to a grain bin.

As shown in both FIGS. 2 and 3, the inventor provides for a plurality of support members (19). Each support member (19) rests flush against the first tube (16) and attaches by means of a wedge-shaped support (21) to a support collar (22) that has been attached to the second tube (17). By use of this arrangement, the first tube (16) may be snugly disposed between the support members (19) and thereby attached to the second tube (17).

The remaining end of the second tube (17) may then be attached to the grain bin (11) by means of an annularly formed angle iron (23) or some other appropriate means of attachment.

With continued reference to FIG. 3, the motor and fan blade unit (13) will now be described. The motor and fan blade unit (13) includes a motor (24), a motor mount (26), a shaft (27) and a fan blade (28). Because of the improved performance realized by use of the supplemental feed unit (14) described below, the motor (24) as installed in the original ventilation air control unit may be retained for this application. It may be necessary, however, to move the motor mount (26) within the first tube (16) somewhat such that the fan blade (28) will be disposed within the second tube (17).

Still with continued reference to FIG. 3, the supplemental feed unit (14) will be described. The supplemental feed unit (14) includes two primary elements. First, to improve static pressure and CFM output and to avoid air slippage around the tips of the fan blade (28), the applicant provides for an annularly shaped flange (29) to be disposed upstream of and proximal to the fan blade (28). Although a simple flat washer shaped flange (29) will improve performance, the applicant has determined that a downstream projection at its inner edge or, more ideally, a truncated hollow cone shaped member having arcuately shaped sides provides better performing characteristics.

The remaining primary element of the supplemental feed unit (14) includes a plurality of gated inlet ports disposed about the pneumatic pathway unit (12). In the embodiment shown in FIG. 3, these ports are formed by the gap that exists between the first tube (16) and the second tube (17). A plurality of gates (31) are provided and may be slidably disposed between the support members (19) that connect the first tube (16) with the second tube (17).

Provided with handles (32), these gates (31) may be moved back and forth parallel to the axis of the pneumatic pathway (12). As shown in FIG. 3 also designated by the numeral 34, such a gate (31), has been moved into contact with the annularly shaped flange (29). So disposed, the port will be closed and no air may pass therethrough. The gate (31), also shown by the numeral 36 has been moved away from the annularly shaped flange (29) and air may enter through the port into the pneumatic pathway (12) as represented by the arrow (37). As stated above, for the first embodiment, it is anticipated that gates 31 will be in an open position (37) when air is being forced into bin (11) and in closed position (36) when air is being drawn out.

Figure 4:
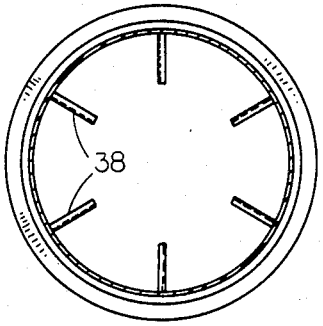
FIG. 4 is a side elevational view of the ventilation air control unit as shown sectioned through the plane indicated in FIG. 3.

If desired, a plurality of flow guide members (38) may be disposed within the second tube (17) as depicted in FIGS. 3 and 4. These flow guides (38) will assist in providing an evenly distributed cross section of air into the grain bin (11).

Figure 5:
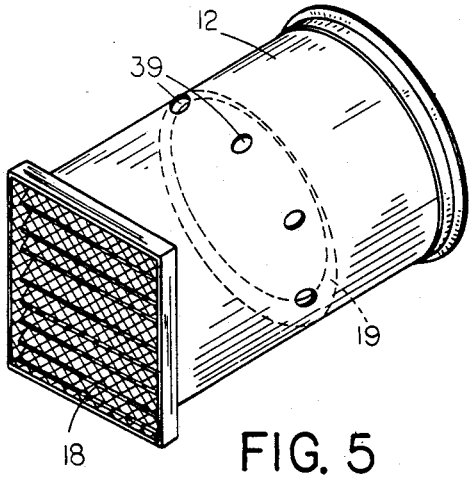
FIG. 5 is a perspective view of another embodiment of the ventilation air control unit.

Referring now to FIG. 5, it will be appreciated that the benefits of the supplemental feed unit (14) may be realized also by providing a pneumatic pathway unit (12) comprised of a single diameter tube which has an annularly shaped flange (29) disposed within the pneumatic pathway (12) upstream of and proximal to the fan blade (28) (not shown in FIG. 5). To provide the greater source of air resulting from the gap between tubes (16 and 17) of the embodiment of FIGS. 1 through 4, supplemental air inlet ports (39) may be provided through the pneumatic pathway (12) upstream of and proximal to the annular shaped flange (19).

Figure 6:
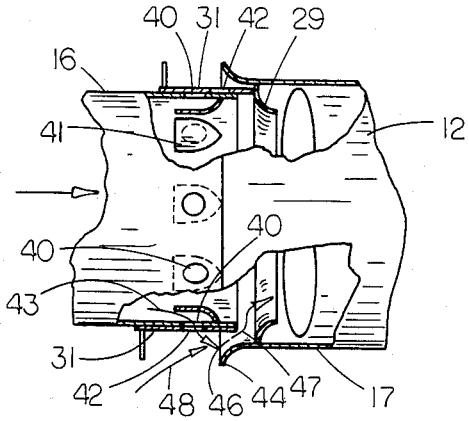
FIG. 6 is a side elevational view of yet another embodiment of the ventilation air control unit, shown sectioned as in FIG. 3, having air flow augmentation scoops attached thereto.

Yet another embodiment of my invention is disclosed in FIG. 6, where a plurality of air flow augmentation scoops (41) are shown disposed within first tube (16) and under outlet ports (40). The scoops (41) are semi-bullet nosed in shape with the large end open to upstream air flow. It should be understood that other shapes would generally work, such as a pointed scoop comprising two or more triangles. In this embodiment gate units (31) have ports (42) which match, in size and spacing outlet ports (40). When gate units (31) are open as seen at the bottom of FIG. 6, ports (42) in gates (31) will align with outlet ports (40), thereby allowing the passage of air from scoops (41) through ports (40) and (42) in the direction of arrow (43).

In operation air will strike extension lip (44) of the second tube (17) and thereby be forced back into the interior of pneumatic pathway unit (12) through inlet port (46) as indicated by arrow (47). The continuous flow of air out and back into the pneumatic pathway unit (12) will create negative pressure in the vicinity, having sufficient suction to draw increased quantities of ambient air into the system as indicated by arrow (48). This configuration will provide an increase in the air intake and subsequent air movement through the pneumatic pathway unit (12).

As seen at the top of FIG. 6, gates (31) are dimensioned, and ports (42) are located therein, so as to be unaligned with ports (40) when gates (31) are moved to the closed position.

Having hereby disclosed the subject matter of this invention, it should be obvious that many modifications, substitutions, and variations of the present invention are possible in light of the above teachings. It is therefore to be understood that the invention may be practised other than as specifically described, and should be limited only by the breadth and scope of the appended claims.

I claim:

1. An improved ventilation air control unit of the type having a pneumatic pathway and a fan and motor unit disposed within said pneumatic pathway for causing air to be moved therethrough, the improvement comprising:

(a) forming said pneumatic pathway of two tubes connected together, the first of said tubes having an interior diameter that is smaller than the interior diameter of the second of said tubes;

(b) positioning said fan blade and motor unit such that said fan blade may rotate within said second tube; and (c) a supplemental feed unit for reducing air slippage around the fan blade that includes:

(i) a substantially annularly shaped flange disposed within said pneumatic pathway upstream of and proximal to said fan blade;

(ii) at least one pneumatic port unit disposed through said pneumatic pathway upstream of said annularly shaped flange; and (iii) at least one air flow augmentation scoop disposed on the interior wall of said pneumatic pathway under each of said port units, whereby air from the pneumatic pathway interior flows from said scoops through said ports in said pneumatic pathway wall to the exterior of said ventilation air control unit and back into the interior through the larger diameter tube.

2. The supplemental feed unit of claim 1 wherein said pneumatic port unit includes a gate such that said pneumatic port units may be selectively closed and opened.

3. The improved ventilation air control unit of claim 1 wherein said pneumatic pathway pneumatically connects to a grain drying bin.

4. An improved ventilation air control unit of the type having a pneumatic pathway having an air inlet and an air outlet, and a fan blade and motor unit disposed within said pneumatic pathway between said inlet and outlet for causing air to be moved therethrough, the improvement comprising a supplemental feed unit that includes a substantially annularly-shaped flange disposed within said pneumatic pathway upstream of and proximal to said fan blade, said flange having an inner diameter of a magnitude less than the overall span of the fan blade for redirecting the flow of air away from the tips of the fan blade and toward its center and at least one pneumatic port unit disposed through said pneumatic pathway upstream of said annularly shaped flange at a location which permits the fan to pull additional air first into said pneumatic pathway and then through the opening within said annular flange.

5. The improved ventilation air control unit of claim 4 wherein said annularly-shaped flange further includes a downstream projection of its inner edge.

6. The improved ventilation air control unit of claim 5 wherein said downstream projection has arcuately shaped sides.

7. The improved ventilation air control unit of claim 6 wherein said pneumatic port unit includes a gate such that said pneumatic port unit may be selectively closed and opened.

8. The improved ventilation air control unit of claim 4 wherein said pneumatic pathway includes a first part having a first interior diameter and a second part having a second interior diameter, said fan blade being located within the second part, and both the second interior diameter and the span of the fan blade being larger than the first interior diameter.

* * * * *